US005787776A

United States Patent [19]

Nishimoto

[11] Patent Number: 5,787,776

[45] Date of Patent: Aug. 4, 1998

[54] FOOD SLICER

[75] Inventor: Yoshitaka Nishimoto, Wakayama, Japan

[73] Assignee: Ryowa Co., Ltd., Wakayama-ken, Japan

[21] Appl. No.: 618,603

[22] Filed: Mar. 20, 1996

[30] Foreign Application Priority Data

Mar. 22, 1995 [JP] Japan ..... 7-062917

[51] Int. Cl.[6] ..... B26D 27/00

[52] U.S. Cl. ..... 83/76.7; 83/92; 83/355; 83/367; 83/409; 83/932

[58] Field of Search ..... 83/92, 932, 409, 83/355, 350, 367, 422, 409.1, 410, 410.7, 410.8, 410.9, 411.7, 76.7

[56] References Cited

U.S. PATENT DOCUMENTS

| | | | |
|---|---|---|---|
| 3,161,215 | 12/1964 | Werder et al. | 83/92 X |
| 3,821,913 | 7/1974 | Bajcar et al. | 83/92 |
| 3,824,885 | 7/1974 | Marshall et al. | 83/19 |
| 4,405,186 | 9/1983 | Sandberg et al. | 83/92 X |
| 4,428,263 | 1/1984 | Lindee et al. | 83/422 X |
| 4,760,765 | 8/1988 | Nishimoto et al. | 83/92 |
| 4,913,019 | 4/1990 | Hayashi | 83/422 X |

FOREIGN PATENT DOCUMENTS

| | | |
|---|---|---|
| 2-106298 | 2/1990 | Japan . |
| 2-15357 | 2/1990 | Japan . |
| 3-218418 | 3/1991 | Japan . |
| 7-108493 | 7/1995 | Japan . |

*Primary Examiner*—Maurina T. Rachuba
*Attorney, Agent, or Firm*—Wenderoth, Lind & Ponack, L.L.P.

[57] ABSTRACT

A food slicer includes a feeder for feeding a lump of food in one direction, an end detector for detecting an end portion of the lump of food fed by the feeder, a cutter for cutting the lump of food from its leading end into slices, and slice receivers arranged for advancing to and retracting from a dropping path of the slices released from the cutter. A controller is responsive to a detection signal of the end detector for controlling the advancing and retracting movements of the slice receivers.

6 Claims, 11 Drawing Sheets

FOOD SLICER

FIELD OF THE INVENTION

The present invention relates to a food slicer for slicing lumps of food, such as ham, sausage, or cheese, and producing a heap or stack of slices pieces.

BACKGROUND OF THE INVENTION

Among known food slicers is a ham slicer as shown in FIG. 12. In such ham slicer, a load of ham denoted by H is transferred downwardly between a pair of belt conveyors 101 and 102 and is cut into slices of a given thickness by a rotary knife 103 mounted beneath the two belt conveyors 101 and 102. A predetermined number of the slices are dropped and received by one **104*b* of two slice receivers 104*a* and 104*b*** thus forming a heap of the slices (referred to as a sack herein after).

When the slice receiver **104*b* has received a predetermined number of slices in the stack thereon, it moves backwards at a high speed from a dropping path of the slices and transfers the stack by a force of static inertia onto a belt conveyor 105. Simultaneously, the other slice receiver 104*a* advances up to the dropping path to receive a stack of slices. When the slice receiver 104*a* has received the predetermined number of slices in a stack, it moves backwards at a high speed from the dropping path of slices and transfers the stack onto the belt conveyor 105. In turn, the slice receiver 104 is moved forward again to the dropping path. By repeating this procedure, stacks of the predetermined number of slices are formed in succession on the conveyor belt 105**.

The slice receivers **104*a* and 104*b* are coupled to the upper ends of two rotary shafts 106*a* and 106*b* respectively disposed on opposite sides of the belt conveyor 105. The rotary shafts 106*a* and 106*b* are linked to each other at lower ends thereof by a timing belt 107 which is connected through a crank rod 108, a crank 109, and a clutch brake 110 to a motor 111. When the motor 111 actuates one rotation of the crank 109, the rotary shafts 106*a* and 106*b* turn forward and backward through an angle of 180 degrees producing a stroke motion. This motion causes the two slice receivers 104*a* and 104*b*** to changeover their positions.

For forming stacks of a neat, constant shape without horizontal dislocation of slices on the slice receivers **104*a* and 104*b*, a drive mechanism (not shown) linked by a rack 112 and a pinion 113 to each of the rotary shafts 106*a* and 106*b* is provided for controlling the movement of the slice receivers 104*a* and 104*b*. As each of the slice receivers 104*a* and 104*b* receives a stack of slices, its rotary shaft 106*a* or 106*b*** is lowered by the drive mechanism in steps of a distance which is nearly equal to the thickness of a slice. Accordingly, the dropping of slices is maintained to substantially a constant distance.

Such conventional ham slicer however has a disadvantage. The ham H has a shape the diameter of which is smaller towards opposite ends than at its center region. Hence, slices cut by the rotary knife 103 from an end region of the ham H are not of a standard size. The conventional ham slicer fails to automatically remove non-standard slices, thus producing defective stacks including non-standard slices equal to 2% to 10% of the stacks.

The defective stacks are then examined to manually remove the non-standard slices therefrom before being packaged to yield ham products. Simultaneously, normal slices have to be added to the defective stacks. Those operations require considerable amounts of labor and time hence increasing the overall cost of sliced ham production.

It is an object of the present invention, in view of the foregoing predicaments, to provide a food slicer capable of preventing the stacks of slices from being mixed with non-standard slices derived from end regions of each loaf of food.

SUMMARY OF THE INVENTION

For achievement of the above object, a food slicer according to the present invention includes a feeding means for feeding a lump of food in one direction, an end detecting means for detecting an end portion of the lump of food fed by the feeding means, a cutting means for cutting the lump of food from its leading end into slices, slice receivers arranged for advancing to and retracting from a dropping path of the slices released from the cutting means, and a controller means responsive to a detection signal of the end detecting means for controlling the advancing and retracting movements of the slice receivers.

The controlling means is arranged to direct the slice receivers to advance to across the dropping path for receiving a stack of the slices thereon when slices of a standard size are delivered from the cutting means, and to retract from the dropping path when slices of non-standard sizes are delivered from the end portion of the lump of food.

The food slicer also includes a conveyor device mounted beneath the receiving position of the slice receivers across the dropping path for receiving on an upper surface thereof a stack of slices dropped from above and conveying them outwardly of the dropping path.

The controlling means directs the slice receivers to move to and from the dropping path at such a low speed as not to drop slices when the number of the received slices is smaller than a predetermined number, and to retract from the dropping path at such a high speed as to drop the stack of slices by means of static inertia when the predetermined number of the slices have been received.

The slice receivers are arranged for upward and downward movements. The controlling means directs the slice receivers to be lowered by a distance substantially equal to the thickness of the slice upon receiving one slice, and when the predetermined number of the slices have been received to be lowered further to a level just above and adjacent to the upper surface of the conveyor device and then retracted from the dropping path.

The conveyor device includes a discharging means for discharging slices of non-standard sizes.

In the food slicer of the present invention, the lump of food is fed by the feeding means in the one direction to the cutting means, and is cut into slices in succession from its leading end. The end detecting means upon detecting a trailing portion of the lump of food from the feeding means generates and transmits a detection signal. According to the detection signal, the slice receivers are retracted from the dropping path of slices below the cutting means.

More particularly, the detection signal of the end detecting means allows the slice receiver to stay across the dropping path when slices of the standard size are received from the cutting means, and to retract from the dropping path while slices of non-standard sizes are delivered from the end portion of the lump of food. As a result, the slices of the standard size only are received in a stack on the slice receiver without being mixed with non-standard size slices.

When the end portion of the lump of food arrives at the cutting means when the slice receiver has received a smaller number of slices than the predetermined number, the slice receiver with the received slices thereon is retracted at a low speed to allow nonstandard slices to drop directly onto the conveyor device. When cutting of slices of the standard size starts after cutting of the end portion is completed, the slice receiver with the received slices thereon is advanced to across the dropping path at the low speed to receive more slices of the standard size over the previously received slices. Upon the predetermined number of slices being received, the slice receiver is retracted from the dropping path to a position over the conveyor device and then is retracted at the high speed such that the slices are dropped by the effect of static inertia from the slice receiver to the conveyor device.

As the slice receiver is lowered by the distance substantially equal to the thickness of the slice upon receiving one slice, the length of dropping for the slices is maintained constant, thus avoiding horizontal dislocation of the slices on the slice receiver. A resultant stack of the predetermined number of slices on the slice receiver is then lowered further to the level close to the upper surface of the conveyor device before the slice receiver is retracted at the high speed. This allows the stack of slices to be dropped from a shorter distance and thus prevented from disturbing its shape due to a higher impact of dropping.

When the slices of non-standard sizes produced by the cutting means are dropped directly onto the conveyor device, they are conveyed and discarded by the discharging means.

DETAILED DESCRIPTION OF THE INVENTION

Embodiments of the present invention will be described referring to the accompanying drawings.

Figure 1:
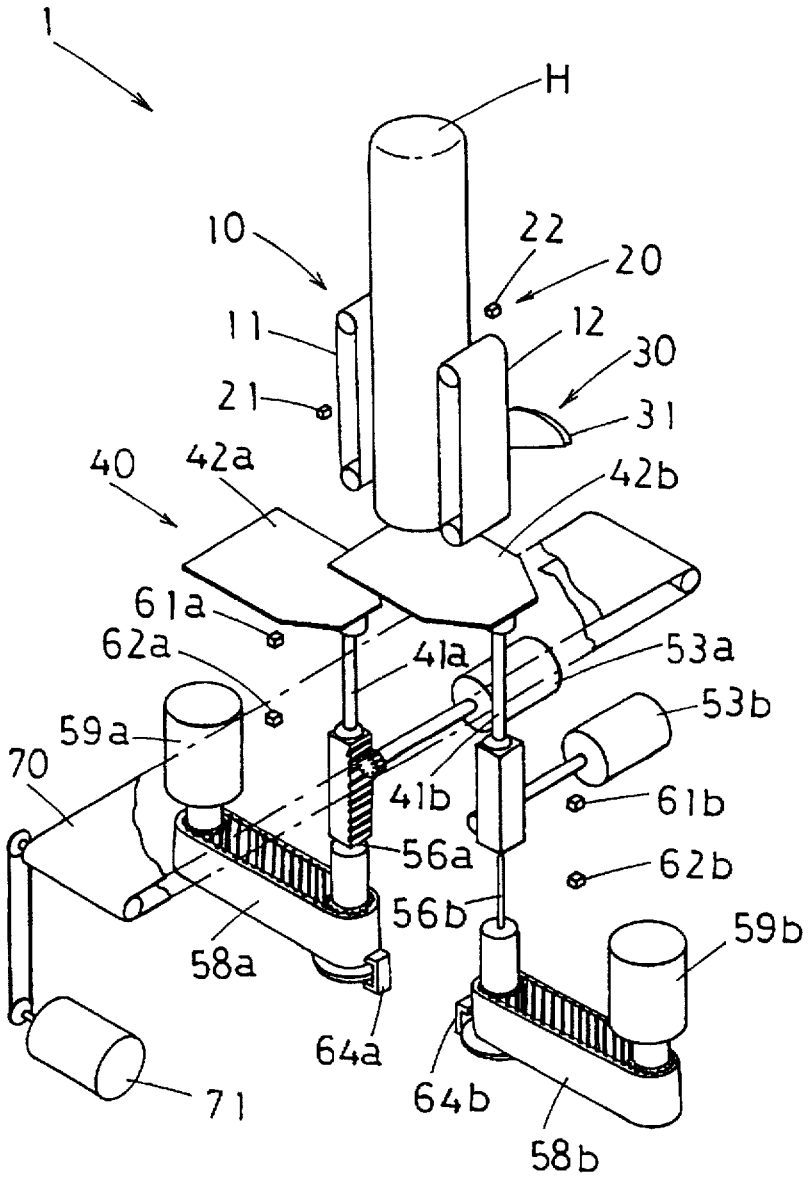
FIG. 1 is a schematic perspective view of a ham slicer showing one embodiment of the present invention.

FIGS. 1 to 6 illustrate a food slicer of the present invention in the form of a ham slicer. As shown in FIG. 1, the ham slicer 1 comprises a feeding means 10 for conveying a loaf of ham H supplied as a loaf of food, an end detecting means 20 for detecting opposite ends of the ham H, a cutting means 30 for cutting the ham H fed by the feeding means 10 into slices in succession, a stacker 40 for receiving slices of ham dropped from the cutting means 30 and grouping them into stacks, and a conveyor device (belt conveyor) 70 for conveying the stacks of slices to outside the ham slicer 1.

Figure 2:
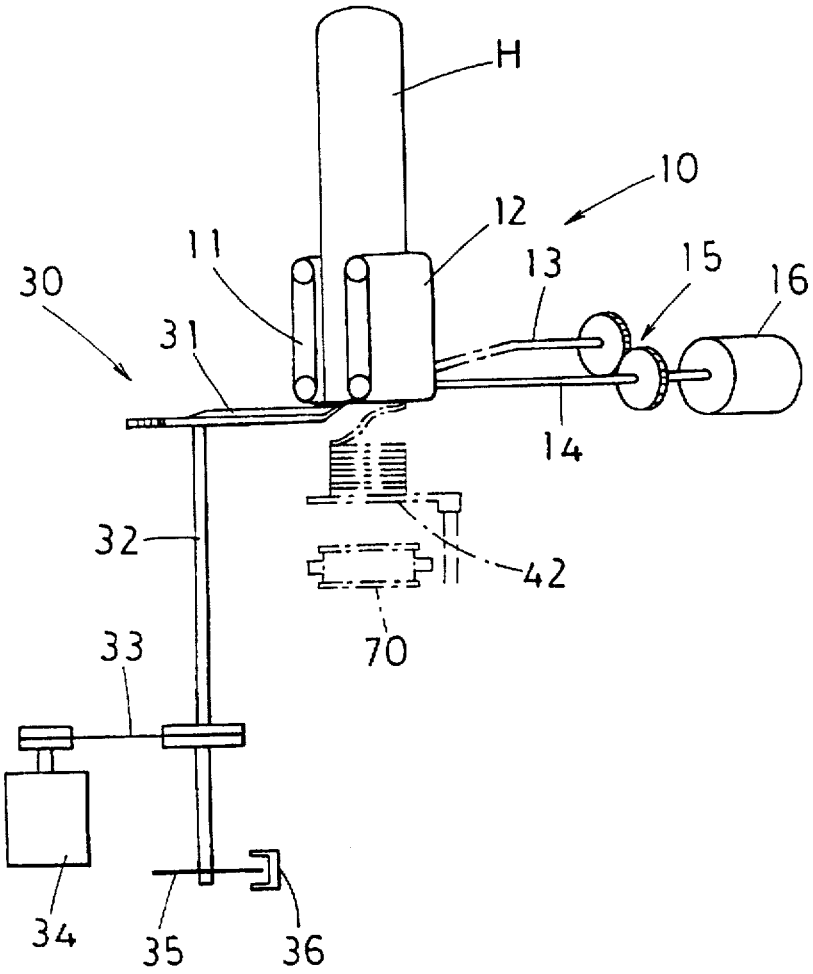
FIG. 2 is an explanatory view of drive mechanisms for a feeding means and a cutting means.

The feeding means 10 includes a pair of belt conveyors 11 and 12 disposed opposite to each other to hold the ham H from both sides. Referring to FIG. 2, the belt conveyors 11 and 12 are driven by two drive shafts 13 and 14, respectively, which are linked to each other by a pair of toothed wheels 15 for rotation at a constant speed in opposite directions to each other. The drive shaft 14 is coupled to a servo motor 16 for driving the belt conveyors 11 and 12 to feed the ham H in a downward direction. Also, an automatic loader (not illustrated) is provided above the feeding means 10 for feeding a number of ham loaves H one by one into the feeding means 10.

The end detecting means 20 comprises a light emitter 21 and a light receiver 22 made of optical sensors. As is apparent from FIGS. 3 and 5, the light emitter 21 and the light receiver 22 are arranged at a horizontal level which is substantially transverse to the holding surface of the belt conveyor 11. As a leading portion of the ham H which is smaller in diameter than its central portion passes across such level, a beam of light emitted from the light emitter 21 runs through a gap created between the holding surface of the belt conveyor 11 and the ham H to the light receiver 22, thus detecting the presence of the leading portion of the ham H.

The cutting means 30 includes a rotary knife 31 mounted beneath the feeding means 10. As shown in FIG. 2, the rotary knife 31 is driven by a drive shaft 32 which is linked by a pulley and belt mechanism 33 to a servo motor 34. The drive shaft 32 has a notched disk 35 mounted to the lower end thereof for allowing an optical sensor 36 to count rotations of the drive shaft 32 and thus of the rotary knife 31.

The stacker 40 includes two rotary shafts 41*a* and 41*b* disposed on opposite sides of the belt conveyor 70, and two slice receivers 42*a* and 42*b* mounted to upper ends of the rotary shafts 41*a* and 41*b*, respectively, so that slice receivers 42*a*, 42*b* are caused to move to and from a path of dropping slices from the cutting means 30 by the rotating action of their respective rotary shafts 41*a* and 41*b*.

Figure 3:
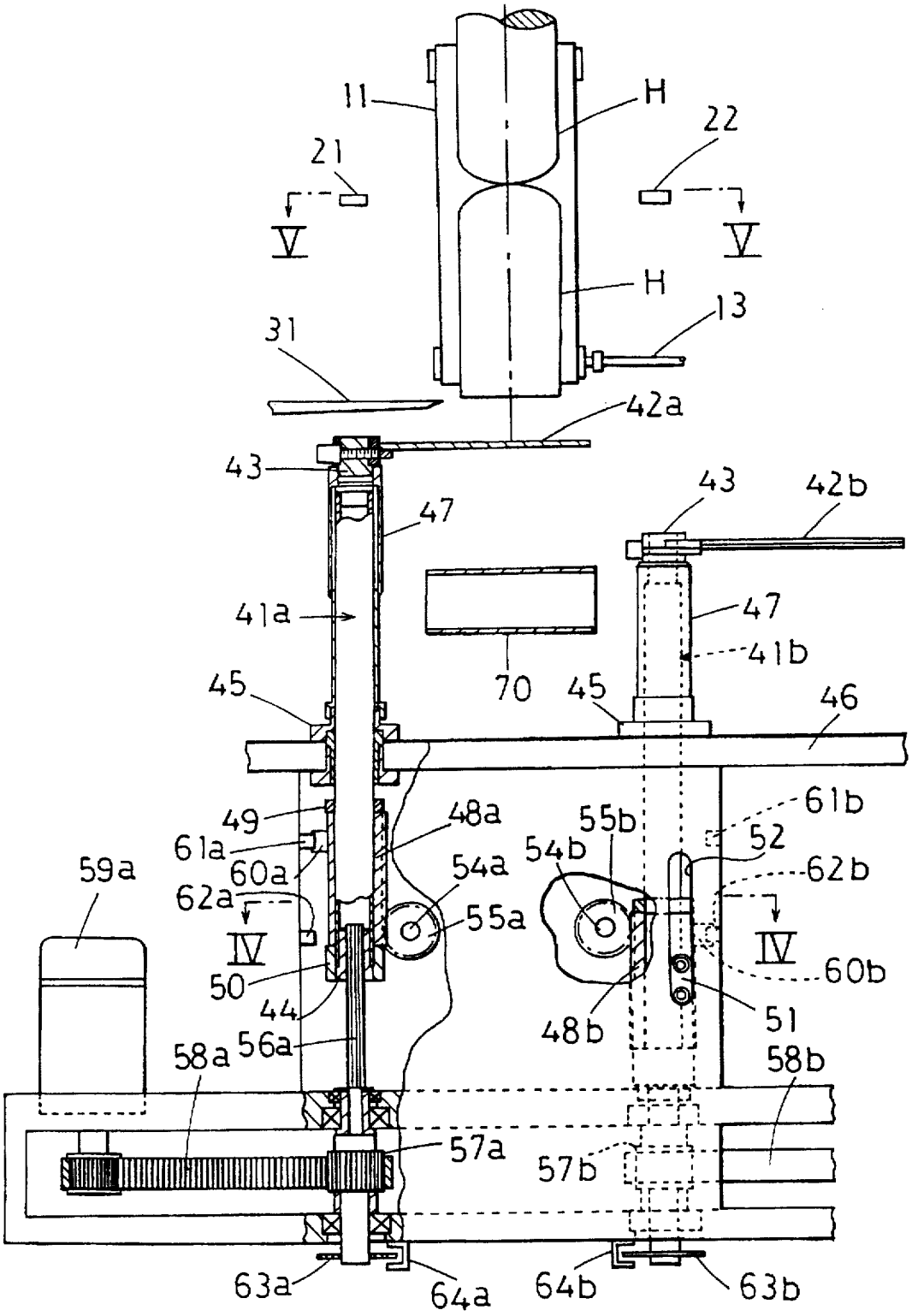
FIG. 3 is a partial cross sectional enlarged front view showing a primary part of the ham slicer.
Figure 4:
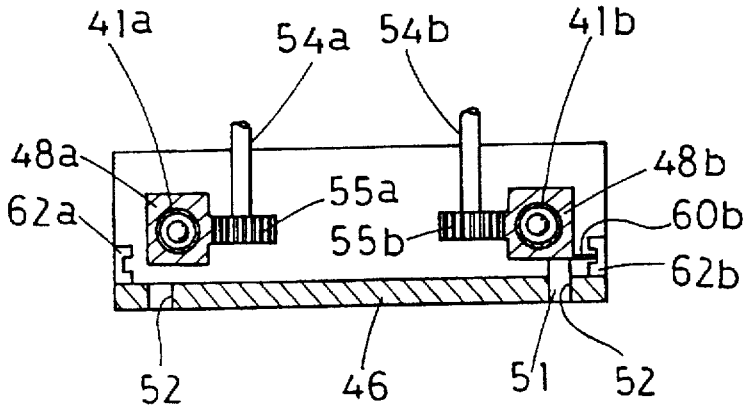
FIG. 4 is a cross sectional view taken along the line IV—IV of FIG. 3.
Figure 5:
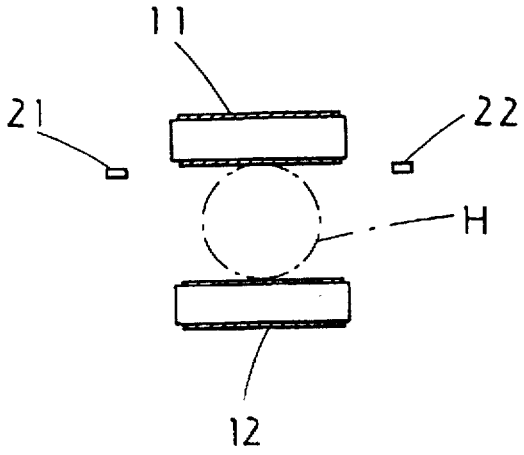
FIG. 5 is a cross sectional view taken along the line V—V of FIG. 3.

Referring to FIGS. 3 and 4, the rotary shafts 41*a* and 41*b* are tubular members which have mounting pegs or plugs 43 fitted into upper ends thereof for detachably holding the slice receivers 42*a* and 42*b*, and spline bosses 44 fitted into lower end thereof. The rotary shafts 41*a* and 41*b* are mounted by members 45 to a platform 46 of the ham slicer 1 for rotating and vertical movements relative thereto. An upper portion of each of the rotary shafts 41*a* and 41*b* above the platform 46 is protected by a respective telescopic cover 47. Also, the rotary shafts 41*a* and 41*b* have respective racks 48*a* and 48*b* fitted onto the lower ends thereof for swivel or rotary movements relative to respective rotary shafts 41*a* and 41*b*.

Vertical movement of the racks 48*a* and 48*b* relative to respective rotary shafts 41*a* and 41*b* is prevented by respective pairs of collars 49 and 50 mounted to the rotary shafts 41*a* and 41*b*. Each of the racks 48*a* and 48*b* has a rotation stopper 51 mounted on a side thereof for fitting into and movement along a slot 52 provided in the platform 46. This allows the racks 48*a* and 48*b* to execute vertical movements but not rotating movement relative to the platform 46. The racks 48*a* and 48*b* are arranged in mesh with respective pinions 55*a* and 55*b* mounted on output shafts 54*a* and 54*b* of stepping motors 53*a* and 53*b*, respectively (FIG. 1). The vertical movements of the rotary shafts 41*a* and 41*b* are hence conducted by the rotation motions of respective stepping motors 53*a* and 53*b*.

Spline shafts 56a and 56b are fitted into respective spline bosses 44 for upward and downward sliding movements. The spline shafts 56a and 56b are rotatably mounted at the lower end on the platform 46 and have respective timing pulleys 57a and 57b mounted on lower ends thereof. The two timing pulleys 57a and 57b are linked by timing belts 58a and 58b to respective drives in the form of servo motors 59a and 59b. Hence, the rotating movements of the rotary shafts 41a and 41b are conducted by the rotation of respective servo motors 59a and 59b.

Shield plates 60a and 60b are provided behind the racks 48a and 48b, respectively. Two pairs of optical sensors 61a, 62a, and 61b, 62b are disposed opposite to the shield plates 60a and 60b for detecting vertical movements of respective rotary shafts 41a and 41b (and hence of the slice receivers 42a and 42b. Notched disks 63a and 63b are mounted to the lowermost ends of the spline shafts 56a and 56b, respectively, and optical sensors 64a and 64b are disposed opposite to respective notched disk 63a and 63b for detecting the rotating movements of the rotary shafts 41a and 41b (and hence of the slice receivers 42a and 42b), respectively. A servo motor 71 is provided for driving the belt conveyor device 70.

Figure 6:
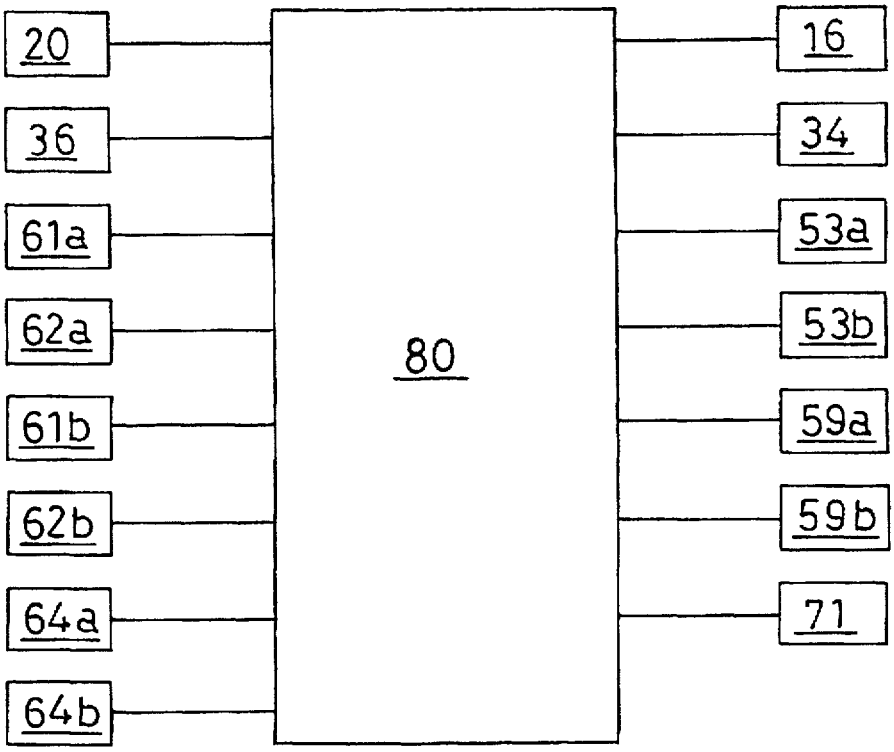
FIG. 6 is a schematic diagram of a controlling means.

FIG. 6 shows a controller means 80 installed in the ham slicer 1. The controlling means 80 is electrically connected with the optical sensors 20, 36, 61a, 61b, 62a, 62b, 64a, and 64b, the servo motors 16, 34, 59a, 59b, and 71, and the stepping motors 53a and 53b. The controller means may be composed of a microcomputer (not shown) including an input/output interface, a CPU, and memories, a driver (not shown) for the servo and stepping motors, and a setting device (not shown) for defining the thickness of a slice and the number of slices in a stack.

The operation of the ham slicer 1 will now be explained. Upon the ham slicer 1 being activated, the belt conveyors 11 and 12 and the rotary knife 31 are driven for running and rotating movements at predetermined speeds. The ham H loaded by the automatic loader into the feeding means 10 is moved downwardly while being held between the two belt conveyors 11 and 12. The ham H upon arriving at the cutting means 30 is cut by the rotary knife 31 into slices of a given thickness and dropped down in succession.

Upon detecting the arrival of a trailing portion of the ham H loaded from the feeding means 10, the end detecting means 20 produces and transmits a detection signal to the controlling means 80 which in turn estimates the arrival of the trailing portion of the ham H at the cutting means 30 and calculates a start time of producing nonstandard slices from the trailing portion of the ham H with reference to the feeding speed of the feeding means 10. When the trailing portion of the ham H and a leading portion of the succeeding ham H have passed and thus, no detection signal is transmitted to the controlling means 80, the controlling means 80 calculates a start time of producing normal slices with reference to the feeding speed.

During a period from the detection of the trailing portion of the ham H at the end detecting means 20 to the start time of producing non-standard slices, normal slices are produced with the cutting means 30. Hence, either of the slice receivers 42a and 42b is advanced across the dropping path to receive the normal slices which thus form a stack on the receiver.

FIG. 7(*a*) shows the slice receiver 42a being held in its standby state or position at the upper limit of its vertical movement defined by the optical sensor 61a, while the slice receiver 42b remains extending across the dropping path and receiving slices dropped from above. As the slice receiver 42b is receiving slices, its rotary shaft 41b is lowered by a distance equal to the feeding distance of the feeding means 10 in response to the detection of one rotation of the rotary knife 31 by the optical sensor 36. Accordingly, the slice receiver 42b upon receiving one slice of the ham H is lowered by substantially the thickness of the slice. This allows the length of the dropping path to be maintained constant, hence contributing to the placement of the slices one over the other with no horizontal dislocation between slices. As a result, the slices are neatly piled in a stack.

When the rotation of the rotary knife 31 measured by the optical sensor 36 reaches a predetermined number (five in the illustrated embodiment) of slices, the slice receiver 42b is lowered from its receiving position where the last or fifth slice has been received to the lower limit of vertical movement defined by the optical sensor 61b which is just above the conveying surface of the belt conveyor 70. Simultaneously, the rotary shaft 41a turns 180 degrees to carry its slice receiver 42a to the dropping path of subsequently cut slices (FIG. 7(*b*)).

Figure 7A:
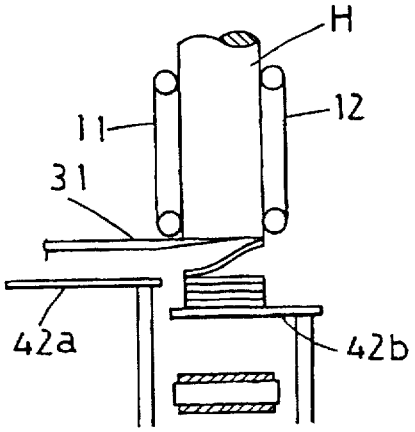
FIGS. 7(*a*)–7(*f*) and 8(*c*1)–8(*c*3) are explanatory views showing steps of operation of a slice receiver.
Figure 7D:
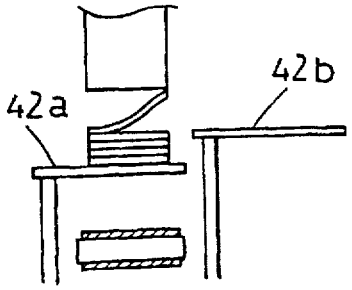
Figure 7B:
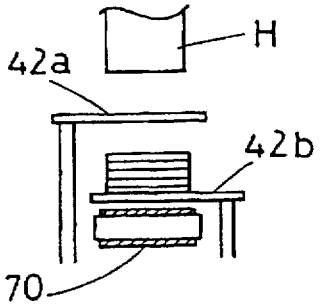
Figure 7E:
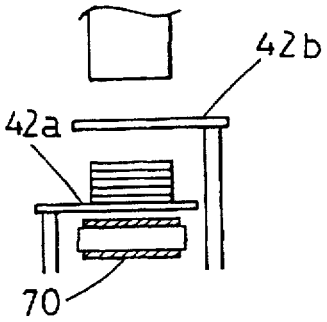
Figure 7C:
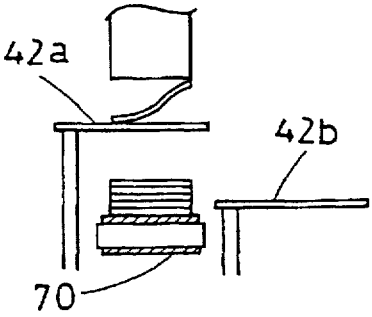
Figure 7F:
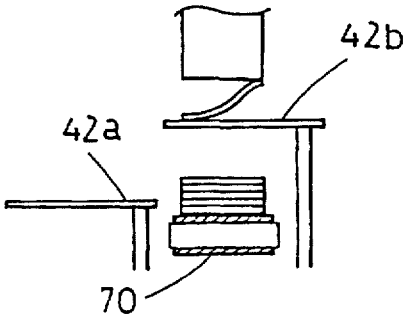

Also, the rotary shaft 41b is turned 180 degrees to retract slice receiver 42b from the dropping path (FIG. 7(c)). The retraction of the slice receiver 42b is executed at a sufficiently high speed to cancel or overcome the force of friction between the stack and the slice receiver 42b. Accordingly, the stack is dropped on the belt conveyor 70 by inertia and is conveyed from the ham slicer 1. As the slice receiver 42b is lowered as close as possible to the belt conveyor 70, the distance of dropping of the stack is minimized to ensure that no excessive impact is imparted to the stack to disturb the shape of the stack. Similarly, the slice receiver 42a, like the slice receiver 42b, is lowered upon receiving a slice until a stack of slices is formed thereon (FIG. 7(*d*)).

During the time slice receiver 42a is receiving slices and being lowered, the unloaded slice receiver 42b is lifted upwardly to the upper limit of its vertical movement defined by the optical sensor 61b and is held in a standby state (FIG. 7(*d*)).

The slice receiver 42a after receiving the fifth slice is further lowered to the lower limit of its vertical movement defined by the optical sensor 61a to just above the belt conveyor 70. Then, the rotary shaft 42b is turned 180 degrees in a direction reverse to the direction shown in FIG. 7(*c*) so that the slice receiver 42a is across the dropping path (FIG. 7(*e*)).

Next, the rotary shaft 41a is turned 180 degrees in a direction reverse to the direction shown in FIG. 7(*b*) to retract slice receiver 42a from the dropping path. This retracting movement tion of the slice receiver 42a is also carried out at a sufficiently high speed so that the stack is dropped on the belt conveyor 70 for further conveying to the outside of the ham slicer 1. The slice receiver 42b while being lowered receives slices and forms another stack of slices thereon (FIG. 7 (*f*)). During the time slice receiver 42b is being lowered, the slice receiver 42a moves upwardly to its upper limit and thus is returned to its start state or position shown in FIG. 7(*a*). The above operating steps are performed throughout the time that cutting means 30 produces normal slices.

Figure 8:
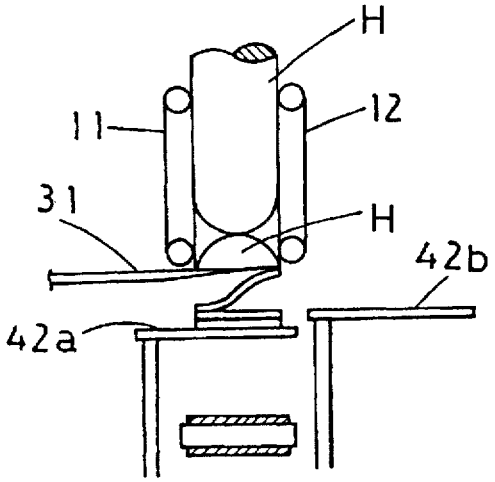
Figure 8:
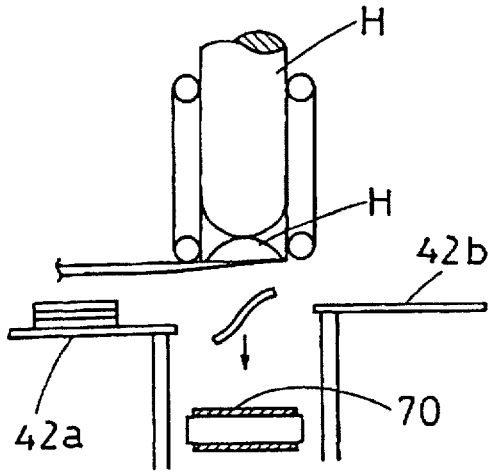
Figure 8:
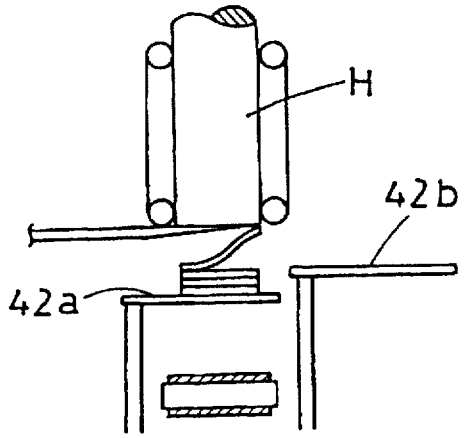

The operation of the ham slicer 1 during the time that cutting means 30 produced non-standard slices will now be explained referring to FIGS. 8(*c*1)–8(*c*3). FIG. 8 (*c*1) shows the slice receiver 42a receiving a third slice after the step shown in FIG. 7(*c*).

When the time period from the detection of the trailing portion of the ham H by the end detecting means 20 to the start time of producing non-standard slices has elapsed, the production of non-standard slices starts. Then, upon the slice receiver 42*a* receiving the third slice, the rotary shaft 41*a* turns 180 degrees. This causes the slice receiver 42*a* to retract from the dropping path of slices while maintaining its height before a next slice is dropped. This retraction of the slice receiver 42*a* is slow enough to hold the slices received thereon without dislocation. Meanwhile, the belt conveyors 11 and 12 as well as the rotary knife 31 remain activated allowing the trailing portion of the ham H to be cut into non-standard slices. The non-standard slices are dropped directly onto the belt conveyor 70 and are conveyed from the ham slicer 1 (FIG. 8(*c*2)).

When the start time of producing normal slices comes after non detection of the trailing portion of the ham H with the end detecting means 20, the production of normal slices starts. The rotary shaft 41*a* turns 180 degrees in a direction reverse to the direction shown in FIG. 8(*c*2), thus causing the slice receiver 42*a* to advance to the dropping path of slices while maintaining its height before a next slice is dropped. Also, the advancing movement of the slice receiver 42*a* is slow enough to hold the slices received thereon without dislocation. The slice receiver 42*a* while being lowered by intervals of a distance equal to the thickness of the slice receives fourth and more slices over the three slices received before the retraction of FIG. 8(*c*2), as shown in FIG. 8(*c*3).

This is followed by the previously described steps starting from FIG. 7(*d*). Although FIGS. 8(*c*1)–8(*c*3) illustrate the retracting movement of the slice receiver 42*a* to avoid receiving non-standard slices, the same procedure is employed with the slice receivers 42*b*.

As set forth above, this embodiment allows the slice receivers 42*a* and 42*b* to receive only a given number of normal slices without mixing with non-standard slices through their forward and backward movements. Therefore, conventional manual operations of removing nonstandard slices from the stack and adding normal slices to any uncompleted stack are eliminated and the overall production cost of sliced ham will be decreased remarkably.

Figure 9:
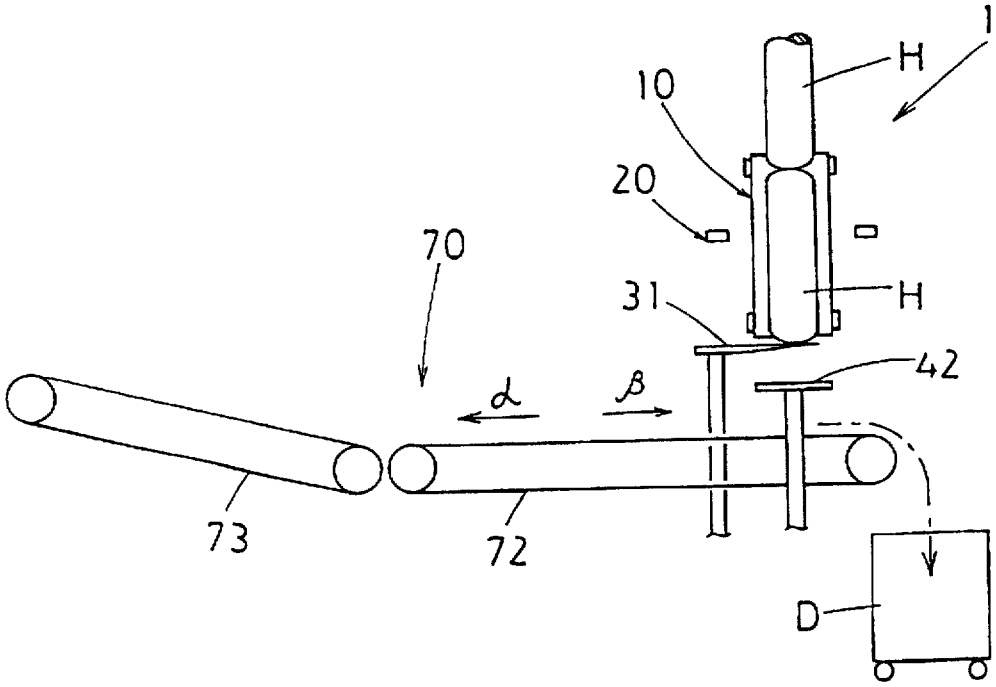
FIG. 9 is a schematic view of a ham slicer showing another embodiment of the present invention.
Figure 10:
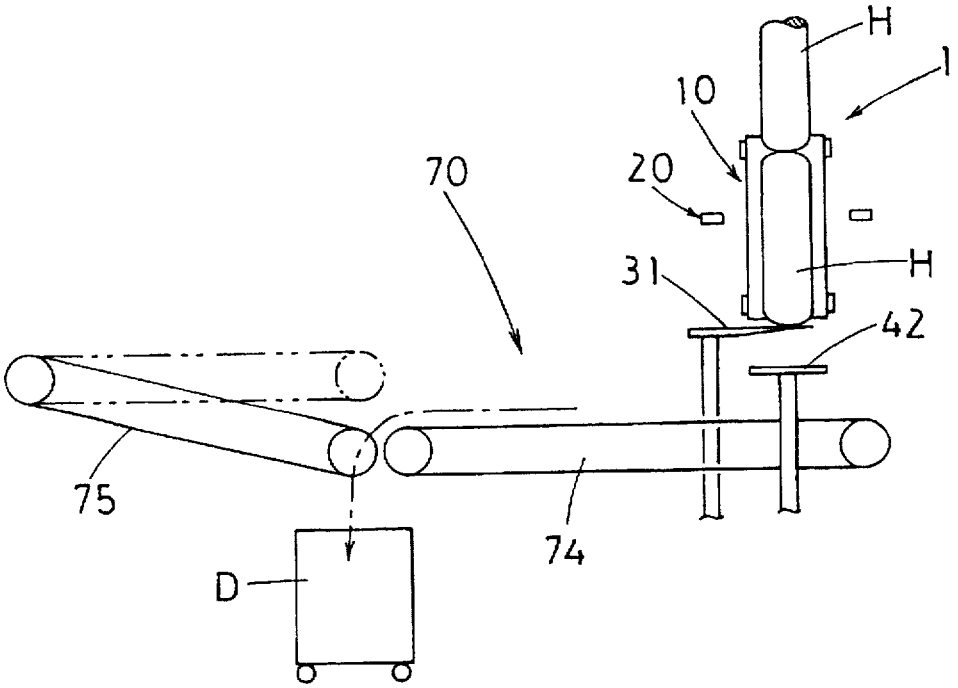
FIG. 10 is a schematic view of a ham slicer showing a further embodiment of the present invention.

FIGS. 9 and 10 illustrate two different embodiments of which ham slicers 1 are identical in construction to that of the previous embodiment and are provided with discharging means respectively coupled to their belt conveyor devices. In the illustrations, denoted by D is a discard box for storage of discharged non-standard slices.

According to the embodiment of FIG. 9, the conveyor device 70 includes a first belt conveyor 72 and a second belt conveyor 73 coupled to the first belt conveyor 72. The first belt conveyor 72 is driven by a motor (not shown) connected to the controlling means of the ham slicer 1. The movement of the belt conveyor 72 is in the directions in normal operation but is shifted to in the direction β when non-standard slices are received. During normal operation, stacks of normal slices are conveyed from the first belt conveyor 72 and the second belt conveyor 73 to the next step. When non-standard slices are received, they are carried in the opposite direction by the first belt conveyor 72 and are dropped from its end into the discard box D.

According to the embodiment of FIG. 10, the conveyor device 70 includes a first belt conveyor 74 disposed beneath the rotary knife 31 and a second belt conveyor 75 coupled to the first belt conveyor 74. The second belt conveyor 75 is provided with a lift device (not shown) for lifting up and down the second belt conveyor 75. The lift device is also connected to the controlling means of the ham slicer 1. The second belt conveyor 75 is normally held at the location denoted by the solid lines in FIG. 10, and is lifted up to the location denoted by the two-dot chain lines when non-standard slices are dropped and received directly on belt conveyor 74, i.e. similar to FIG. 8(*c*2). While stacks of normal slices are conveyed from the first belt conveyor 74 and the second belt conveyor 75 to the next step, the non-standard slices are discharged and dropped through a gap between the two belt conveyors 74 and 75 into the discard box D.

Figure 11A:
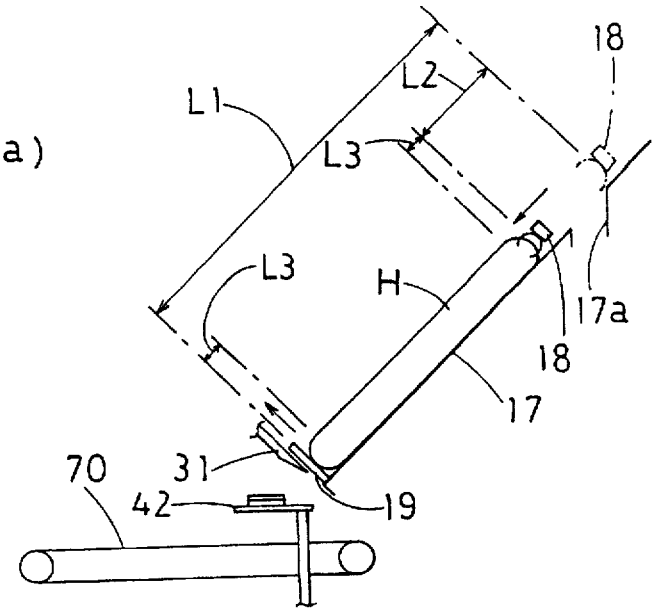
FIGS. 11(*a*)–11(*c*) are schematic explanatory views showing a ham slicer and its operation of a still further embodiment of the present invention.
Figure 11B:
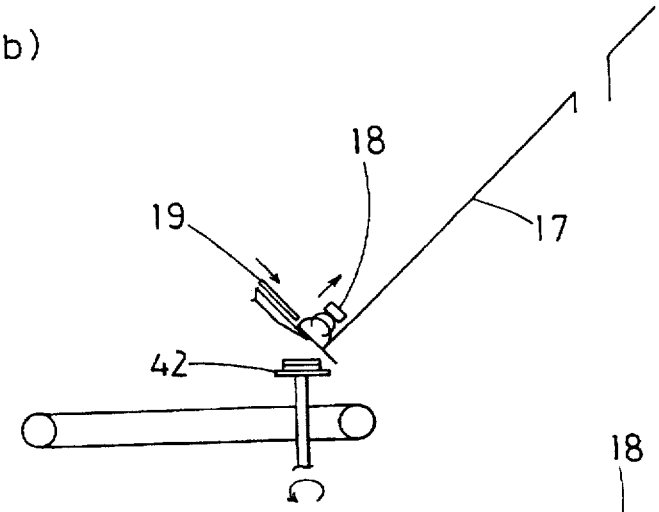
Figure 11C:
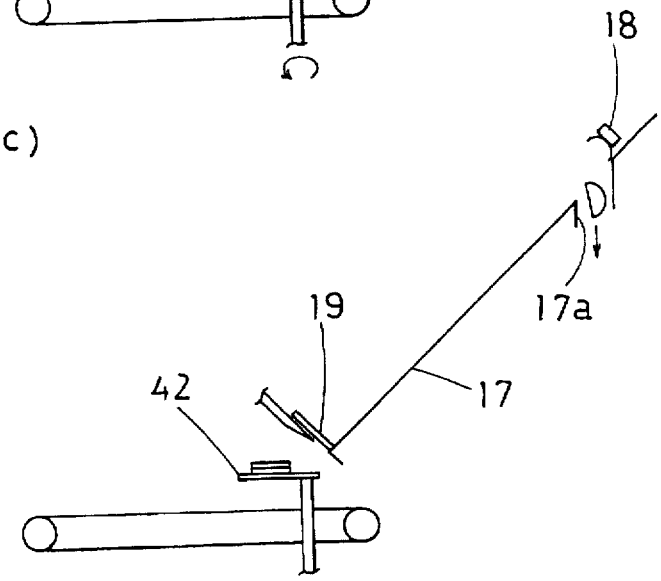
Figure 12:
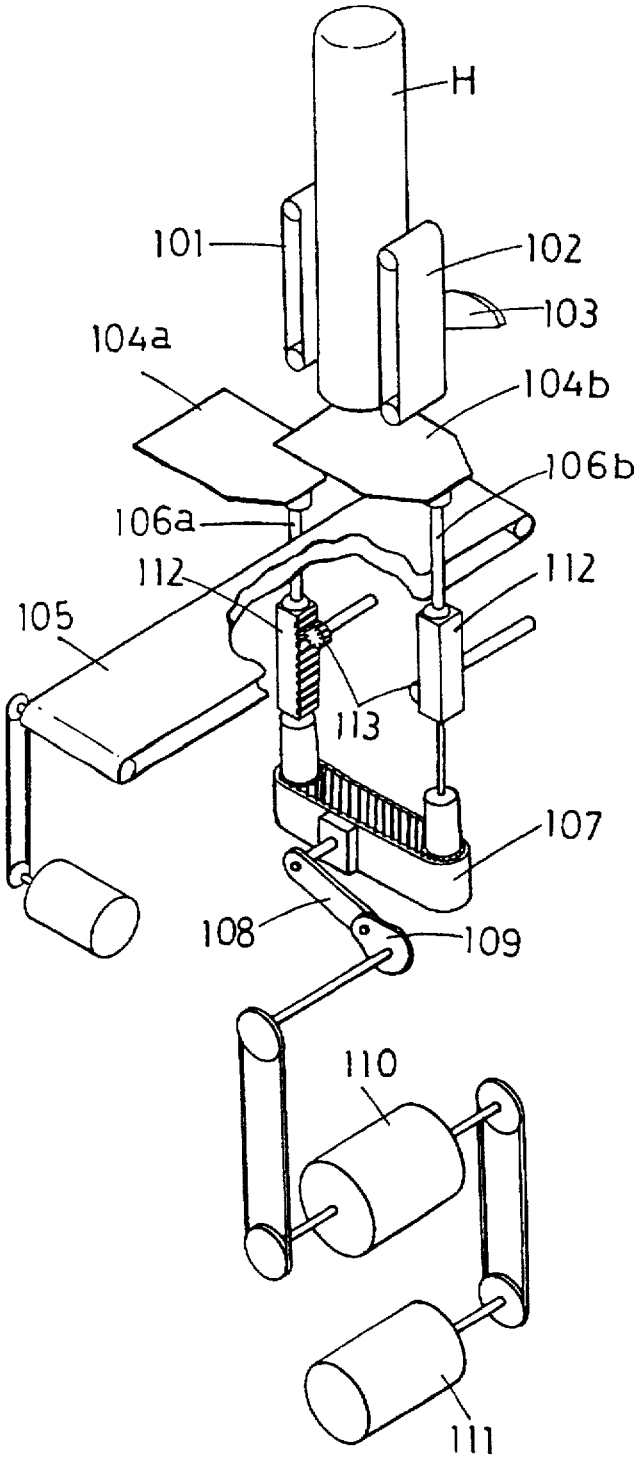
PRIOR ART Fig. 12
FIG. 12 is a schematic perspective view of a conventional ham slicer.

FIGS. 11(*a*)–11(*c*) show a further embodiment of the present invention where the feeding means of a ham slicer is of a grip type. Shown are an inclined plate 17, a scrap discharge opening 17*a* provided above the slope plate 17, a gripper 18 having claws for holding a trailing portion of a loaf of ham H and a limit switch (not shown) for detecting an end portion of the ham H and arranged to be movable up and down along the plate 17, a shutter 19 disposed before the rotary knife 31, and a belt conveyor 70. In addition, a controlling means (not illustrated) for controlling the ham slicer 1 includes a positioning control for the gripper 18 and a setting control for saving the length L3 of both end portions of ham H.

The operation of this embodiment now will be explained. Before a loaf of ham H is loaded onto plate 17, the shutter 19 remains closed with a slice receiver 42 being retracted and holding thereon previously received slices. The gripper 18 with its claws opened stays in an original home position HP thereof above the scrap discharge opening 17*a*.

When the ham H is loaded onto plate 17 by hand or automatic device, the gripper 18 moves down. Upon the gripper 18 reaching the trailing portion of the ham H, it is detected by the limit switch which in turn generates and transmits a detection signal to the controlling means. The controlling means directs the gripper 18 to hold the trailing portion of the ham H with its claws closed and saves a distance L2 from the HP of the gripper 18 to the detection point in its memory (FIG. 11(*a*)).

In response to the shutter 19 being opened, the gripper 18 further moves down and then the leading portion of the ham H is cut by the rotary knife 31 into non-standard slices. At such time, the slice receiver 42 remains retracted allowing the non-standard slices of the leading portion of the ham H to drop directly onto the belt conveyor 70.

When the gripper 18 travels down to a distance (L2+L3) equal to a sum of the saved distance L2 and the length L3 of the end portion of ham H starting from the HP, the leading portion of the ham H has been cut off. Then, the slice receiver 42 is advanced to the dropping path to receive a stack of normal slices which is transferred later onto the belt conveyor 70 in the same manner described above.

When the gripper 18 travels down to a distance (L1–L3) equal to a subtraction of L3 from a distance L1 between the HP and the cutting position, a main portion of the ham H has been cut off. The slice receiver 42 is moved backward with a received slice(s) thereon and simultaneously the upward movement of the gripper 18 starts as is followed by closing of the shutter 19 (FIG. 11(*c*)).

Upon the gripper 18 reaching the HP, its claws are opened to release and drop the trailing portion of the ham H through the scrap discharge opening 17*a*. Gripper 18 stays at such position until another load of ham H is loaded. In this embodiment, the gripper 18 acts as the feeding means and the limit switch serves as the end detecting means.

It will be understood that the ham slicer of the present invention is not limited to the ham slicers of the above described embodiments which are illustrative.

What is claimed is:

1. A food slicer comprising:

a feeding means for feeding a lump of food in one direction;

an end detecting means for detecting an end portion of the lump of food fed by said feeding means;

a cutting means for cutting the lump of food from a leading end thereof into slices;

first and second slice receivers driven independently by first and second drives, respectively, for movements advancing to and retracting from a dropping path of slices released from the lump of food by said cutting means; and controller means, operably connected to said first and second drives and responsive to a detection signal from said end detecting means, for controlling said advancing and retracting movements of said first and second slice receivers and for ensuring that both said first and second slice receivers are retracted from said dropping path when slices of non-standard sizes representative of cutting of the end portion of the lump of food are delivered by said cutting means.

2. A food slicer according to claim 1, wherein said controller means is operable to move a respective said slice receiver to advance across said dropping path for receiving a stack of slices when slices of a standard size are delivered by said cutting means, and to retract from said dropping path when the slices of non-standard sizes are delivered.

3. A food slicer according to claim 2, further comprising a conveyor device mounted beneath a receiving position of said slice receivers across said dropping path for receiving a stack of slices dropped from above and conveying the stack outwardly of said dropping path, and wherein said controller means is operable to move a respective said slice receiver to and from said dropping path at a sufficiently low speed to maintain the stack of slices on said respective slice receiver when the number of the slices of the stack is smaller than a predetermined number, and to retract said respective slice receiver from said dropping path at a sufficiently high speed to prevent the stack of the slices from moving with said respective slice receiver and to drop by static inertia onto said conveyor device when the stack includes the predetermined number of the slices.

4. A food slicer according to claim 3, further comprising means for moving said slice receivers upwardly and downwardly, and said controller means is operable to lower a respective said slice receiver by a distance substantially equal to the thickness of a slice received on said respective slice receiver and when the predetermined number of slices have been received on said respective slice receiver, to further lower said respective slice receiver to a level just above and adjacent to an upper surface of said conveyor device, and then to retract said respective slice receiver from said dropping path.

5. A food slicer according to claim 4, wherein said conveyor device comprises a discharging means for discharging the slices of non-standard sizes.

6. A food slicer according to claim 3, wherein said conveyor device comprises a discharging means for discharging the slices of non-standard sizes.

* * * * *